US010547962B2

(12) United States Patent
Suenaga et al.

(10) Patent No.: US 10,547,962 B2
(45) Date of Patent: Jan. 28, 2020

(54) SPEAKER ARRANGED POSITION PRESENTING APPARATUS

(71) Applicant: SHARP KABUSHIKI KAISHA, Sakai, Osaka (JP)

(72) Inventors: Takeaki Suenaga, Sakai (JP); Hisao Hattori, Sakai (JP); Ryuhji Kitaura, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/064,586

(22) PCT Filed: Dec. 21, 2016

(86) PCT No.: PCT/JP2016/088122
§ 371 (c)(1),
(2) Date: Jun. 21, 2018

(87) PCT Pub. No.: WO2017/110882
PCT Pub. Date: Jun. 29, 2017

(65) Prior Publication Data

US 2019/0007782 A1 Jan. 3, 2019

(30) Foreign Application Priority Data

Dec. 21, 2015 (JP) ..... 2015-248970

(51) Int. Cl.
*H04S 7/00* (2006.01)
*H04R 5/04* (2006.01)
(Continued)

(52) U.S. Cl.
CPC ..... *H04S 7/303* (2013.01); *H04R 5/04* (2013.01); *H04S 3/008* (2013.01); *H04S 7/301* (2013.01);
(Continued)

(58) Field of Classification Search
CPC . H04S 7/303; H04S 3/008; H04S 7/00; H04S 7/30; H04S 7/305; H04S 7/308;
(Continued)

(56) References Cited

U.S. PATENT DOCUMENTS

2006/0062401 A1* 3/2006 Neervoort ..... H04S 7/303 381/82
2015/0271620 A1* 9/2015 Lando ..... H04S 5/005 381/18
2017/0201847 A1 7/2017 Fujita

FOREIGN PATENT DOCUMENTS

JP 2006-319823 A 11/2006
JP 2008-227942 A 9/2008
(Continued)

OTHER PUBLICATIONS

Ville Pulkki, Virtual Sound Source Positioning Using Vector Base AmplitudePanning, J. Audio. Eng., vol. 45, No. 6, Jun. 1997.
(Continued)

*Primary Examiner* — Yogeshkumar Patel
(74) *Attorney, Agent, or Firm* — ScienBiziP, P.C.

(57) ABSTRACT

The disclosure automatically calculates an arranged position of a speaker that is suitable to a user, and presents information relating to the arranged position to the user. Aspects relate to a speaker arranged position presenting apparatus for presenting arranged positions of a plurality of speakers configured to output multi-channel audio signals as physical vibrations, the speaker arranged position presenting apparatus including: a speaker arranged position instructing unit configured to calculate arranged positions of the plurality of speakers, based on at least one of a feature amount of input content data or input information for specifying an environment in which the input content data is to be played; and a
(Continued)

presenting unit configured to present the arranged positions of the plurality of the speakers that have been calculated.

6 Claims, 10 Drawing Sheets

(51) Int. Cl.
*H04S 3/00* (2006.01)
*H04R 5/02* (2006.01)

(52) U.S. Cl.
CPC ..... *H04S 7/302* (2013.01); *H04R 5/02* (2013.01); *H04S 2400/01* (2013.01); *H04S 2400/11* (2013.01)

(58) Field of Classification Search
CPC ..... H04S 2400/11; H04S 2420/01; H04S 2400/01; H04S 7/301; H04S 7/302; H04S 5/02; H04S 5/04; H04R 5/02; H04R 5/04; H04R 3/12; H04R 1/26; H04R 3/04
See application file for complete search history.

(56) References Cited

FOREIGN PATENT DOCUMENTS

| | | | |
|---|---|---|---|
| JP | 2013-055439 | A | 3/2013 |
| JP | 2015-167274 | A | 9/2015 |
| JP | 2015-228625 | A | 12/2015 |

OTHER PUBLICATIONS

Multichannel stereophonic sound system with and without accompanying picture, ITU-R BS.775-1.

* cited by examiner

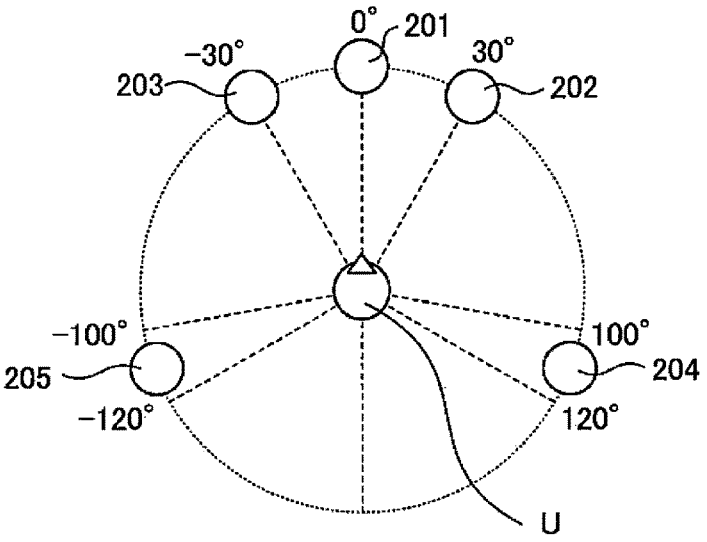
FIG. 2B
| TRACK ID | 1 | |
|---|---|---|
| SOUND PRODUCTION OBJECT POSITION INFORMATION | 0:00:00-0:01:10 | 0° |
| | 0:00:00-0:01:10 | 90° |
| | 0:01:10-0:03:46 | 95° |
| | ... | ... |
FIG. 3
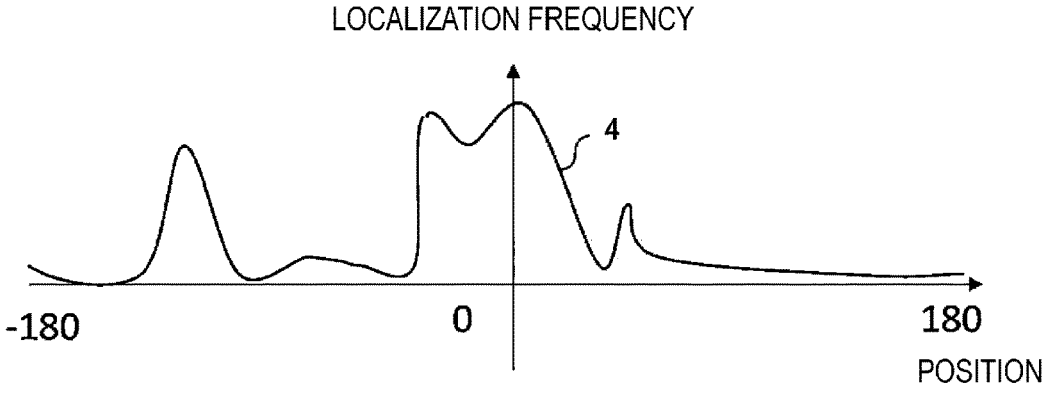
FIG. 4

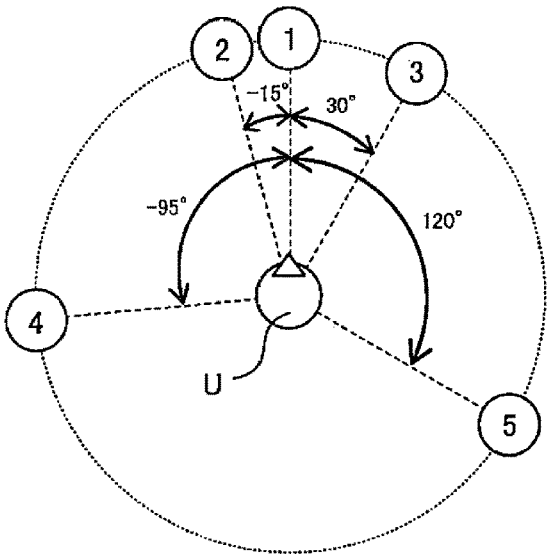
FIG. 10A
| SPEAKER ID | POSITION |
|---|---|
| 1 | 0° |
| 2 | -15° |
| 3 | 30° |
| 4 | -95° |
| 5 | 120° |
FIG. 10B
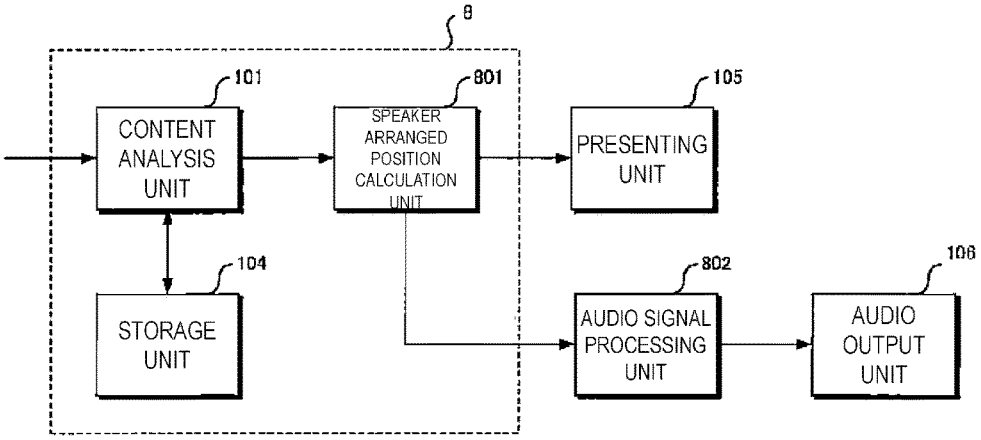
FIG. 11

SPEAKER ARRANGED POSITION PRESENTING APPARATUS

TECHNICAL FIELD

One aspect of the disclosure relates to a technique for presenting arranged positions of a plurality of speakers that output multi-channel audio signals as physical vibrations.

BACKGROUND ART

In recent years, users can easily obtain contents including multi-channel audio (surround sound) via broadcast waves, disk media such as Digital Versatile Discs (DVDs) and Blu-Ray (trade name) Discs (BD), the Internet, and the like. In movie theaters and the like, a large number of stereophonic systems using object-based audio, such as Dolby Atmos, are deployed. Furthermore, in Japan, as 22.2 ch audio is adopted as the next generation broadcast standard, for example, opportunities for users to experience multi-channel contents have dramatically increased.

Various investigations of multi-channel conversion methods for known stereophonic audio signals have also been conducted, and a technique for multi-channel conversion based on the correlation between the channels of a stereo signal is disclosed in PTL 2, for example. Also, with respect to systems that play multi-channel audio, in addition to facilities equipped with large-scale audio equipment such as movie theaters and halls, systems that can be enjoyed easily at home and the like are becoming more common. By placing a plurality of speakers according to arrangement standards recommended by the International Telecommunication Union (ITU) (see NPL 1), a user (listener) can construct an environment for listening to multi-channel audio such as 5.1 ch or 7.1 ch in a home. In addition, techniques have been studied that reproduce multi-channel stereo image localization with a small number of speakers (NPL 2).

CITATION LIST

Patent Literature

PTL 1: JP 2006-319823 A
PTL 2: JP 2013-055439 A

Non Patent Literature

NPL 1: ITU-R BS. 775-1
NPL 2: Virtual Sound Source Positioning Using Vector Base AmplitudePanning, VILLE PULKKI, J. Audit, Eng., Vol. 45, No. 6, 1997 June.

SUMMARY

Technical Problem

However, as NPL1 discloses general-purpose techniques regarding speaker arranged positions for multi-channel playback, there are some cases where this cannot be achieved depending on the viewing environment of the user. FIG. 2A illustrates a coordinate system in which the front of the user U is set to 0°, and the right position and left position of the user are set to 90° and −90°, respectively. Using this coordinate system, FIG. 2B, for example, illustrates a recommendation for the 5.1 ch described in NPL 1 of placing the center channel 201 in front of the user in a concentric circle centered on the user U, placing the front right channel 202 and the front left channel 203 at positions of 30° and −30°, respectively, and placing the surround right channel 204 and the surround left channel 205 within ranges from 100° to 120° and −100° to −120°, respectively. However, depending on the viewing environment of the user, such as the shape of the room or the arrangement of the furniture, for example, some speakers cannot be arranged at the recommended positions.

In order to solve these problems, PTL 1 discloses a method for correcting the deviation of the actual speaker arranged position from the recommended position by producing sound from each of the arranged speakers, capturing this sound with a microphone, and providing feedback of a feature amount obtained by analysis to the output audio. However, since the audio correction method of the technique described in 1 performs audio correction based on the positions of the speakers arranged by the user, it is difficult to indicate an overall optimal solution that includes the original positions of the arrangement of the speakers although it is possible to indicate a locally optimized solution within the arrangement of the speakers arranged by the user. For example, in a case where a user arranges speakers in an extreme arrangement, such as concentrating speakers in the front or on the right, a good result of audio correction may not be obtained.

In addition, depending on the content to be viewed, there are cases in which the sound localization may be concentrated in a particular direction, and the actually arranged speakers may be largely unused. For example, audio playback from the rear speakers may not be substantially performed in a content concentrating the audio localization in the front, and the user may suffer a disadvantage that the arranged resources are not utilized.

The disclosure has been made in view of these circumstances, and has an object of providing a speaker arranged position presenting system capable of automatically calculating an arranged position of a speaker that is suitable for a user and providing this arranged position information to the user.

Solution to Problem

In order to accomplish the object described above, an aspect of the disclosure is contrived to provide the following measures. That is, the speaker arranged position presenting apparatus of one aspect of the disclosure is a speaker arranged position presenting apparatus for presenting arranged positions of a plurality of speakers configured to output audio signals as physical vibrations, the speaker arranged position presenting apparatus including: a speaker arranged position instructing unit configured to calculate arranged positions of the plurality of speakers, based on at least one of a feature amount of input content data or input information for specifying an environment in which the input content data is to be played; and a presenting unit configured to present the arranged positions of the plurality of speakers that have been calculated.

Advantageous Effects of Disclosure

According to one aspect of the disclosure, it is possible to present arranged positions of the plurality of speakers that are suitable for the content to be viewed and the viewing environment. As a result, users can construct a more suitable audio viewing environment.

BRIEF DESCRIPTION OF DRAWINGS

FIG. 2B is a diagram schematically illustrating a coordinate system.

FIG. 3 is a diagram illustrating an example of metadata in the first embodiment.

FIG. 4 is a diagram illustrating an example of a histogram of localization frequencies.

FIG. 10A is a diagram illustrating a presentation example output by the speaker arranged position instructing system according to the first embodiment.

FIG. 10B is a diagram illustrating a presentation example output by the speaker arranged position instructing system according to the first embodiment.

FIG. 11 is a diagram illustrating a schematic configuration of the speaker arranged position instructing system according to a first modification of the first embodiment.

DESCRIPTION OF EMBODIMENTS

The inventors of the disclosure focused on the fact that, when a user plays a multi-channel audio signal and the multi-channel audio signal is output from a plurality of speakers, depending on a feature amount of content data and arranged positions of the plurality of speakers in a viewing environment, suitable viewing may not be possible. Accordingly, the inventors discovered that by calculating the arranged positions of the plurality of speakers, based on the feature amount of the content data and information for specifying the viewing environment, it is possible to present the arranged positions of the plurality of speakers that are suitable for the content to be viewed and the viewing environment, which led to an aspect of the disclosure.

That is, the speaker arranged position presenting system (speaker arranged position presenting apparatus) of one aspect of the disclosure is a speaker arranged position presenting system for presenting the arranged positions of the plurality of speakers configured to output multi-channel audio signals as physical vibrations, the speaker arranged position presenting system including: an analysis unit configured to analyze at least one of a feature amount of input content data or information for specifying an environment in which the input content data is to be played; a speaker arranged position calculation unit configured to calculate the arranged positions of the plurality of speakers, based on the feature amount or the information for specifying the environment, which has been analyzed; and a presenting unit configured to present the arranged positions of the plurality of speakers that have been calculated In this way, the inventors of the disclosure have made it possible to present arranged positions of speakers that are suitable for the content to be viewed and the viewing environment, such that users may construct more suitable audio viewing environments. Embodiments of the disclosure will be described below in detail with reference to the drawings. It should be noted that, in the present disclosure, the speaker refers to a loudspeaker.

First Embodiment

Figure 1:
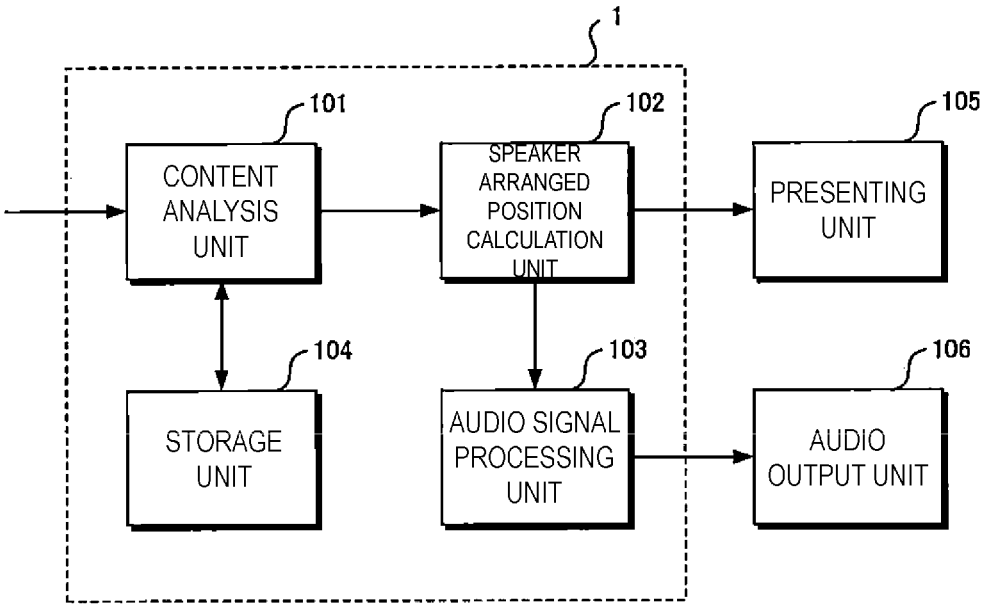
FIG. 1 is a diagram illustrating a schematic configuration of a speaker arranged position instructing system according to a first embodiment.

FIG. 1 is a diagram illustrating a primary configuration of a speaker arranged position instructing system according to a first embodiment of the disclosure. The speaker arranged position instructing system 1 according to the first embodiment analyzes a feature amount of content to be played, and instructs a suitable speaker arranged position based on the feature amount. That is, as illustrated in FIG. 1, the speaker arranged position instructing system 1 includes a content analysis unit 101 configured to analyze audio signals included in video content and audio content recorded on a disk medium such as DVD and BD, a Hard Disc Drive (HDD) or the like, a storage unit 104 configured to record an analysis result obtained by the content analysis unit 101 and various parameters necessary for content analysis, a speaker arranged position calculation unit 102 configured to calculate the arranged positions of the speakers based on the analysis results obtained by the content analysis unit 101, and an audio signal processing unit 103 configured to generate and re-synthesize the audio signals to be played by the speakers based on the arranged positions of the speakers calculated by the speaker arranged position calculation unit 102.

In addition, the speaker arranged position instructing system 1 is connected to external devices including a presenting unit 105 configured to present the speaker positions to a user, and an audio output unit 106 configured to output an audio signal that has undergone signal processing. A speaker arranged position presenting apparatus includes the speaker arranged position instructing system (speaker arranged position instructing unit) 1 and the presenting unit 105.

Regarding Content Analysis Unit 101

The content analysis unit 101 analyzes a feature amount included in the content to be played and sends the information on the feature amount to the speaker arranged position calculation unit 102.

(1) In Cases that Object-Based Audio is Included in Playback Content

In the present embodiment, in a case that object-based audio is included in the playback content, a frequency graph of the localization of the audio included in the playback content is generated using this feature amount, and the frequency graph is set as the feature amount information to be sent to the speaker arranged position calculation unit 102.

First, an outline of object-based audio will be described. Object-based audio is a concept in which sound-producing objects are not mixed and suitably rendered on the player (playback device) side. Although there are differences among standards, in general, metadata (associated information) that include when, where, and at what volume level sound should be produced is linked to each of these sound-producing objects, and the player renders the individual sound-producing objects based on the metadata.

In the present embodiment, audio localization position information for an entire content is determined by analysis of this metadata. It should be noted that, for the sake of simplifying the explanation, as illustrated in FIG. 3, it is assumed that the metadata include a track ID indicating a track to which a sound-producing object is linked to, and one or more sets of sound-producing object position information composed of a pair of a playback time and a position at the playback time. In the present embodiment, it is assumed that the sound-producing object position information is expressed in the coordinate system illustrated in FIG. 2A. In addition, it is assumed that within the content, this metadata is described in a markup language such as Extensible Markup Language (XML).

The content analysis unit 101 first generates, from all the sound-producing object position information included in the metadata of all the tracks, a histogram 4 of localization positions as illustrated in FIG. 4. This will be specifically described with reference to the sound-producing object position information illustrated in FIG. 3 as an example. The sound-producing object position information indicates that the sound-producing object of track ID 1 remains at a position of 0° for 70 seconds of "0:00:00 to 0:01:10". Here, in a case that the total content length is N (seconds), a value of 70/N obtained by normalizing this retention time of 70 seconds by N is added as a histogram value. By performing the above-described processing with respect to all the sound-producing object position information, a histogram 4 of the localization positions illustrated in FIG. 4 can be obtained.

Figure 2A:
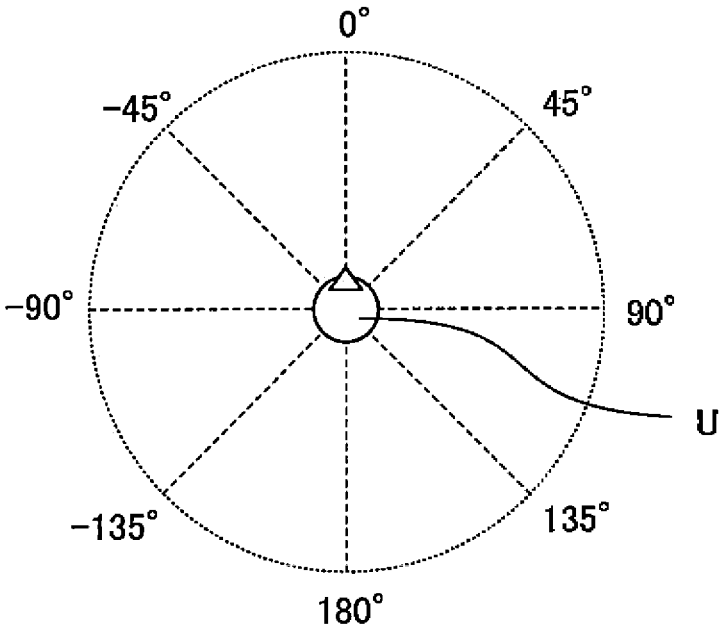
FIG. 2A is a diagram schematically illustrating a coordinate system.

It should be noted that, although the coordinate system illustrated in FIG. 2A has been described as an example of the position information of the sound-producing objects in the present embodiment, it is needless to say that the coordinate system may be a two-dimensional coordinate system expressed by an x-axis and a y-axis, for example.

(2) In Cases that Audio Signals Other than Object-Based Audio are Included in Playback Content In this case, a histogram generation method is as follows. For example, in a case that 5.1 ch audio is included in the playback content, a sound image localization calculation technique based on the correlation information between two channels disclosed in PTL 2 is applied, and a similar histogram is generated based on the following procedure.

Figure 5A:
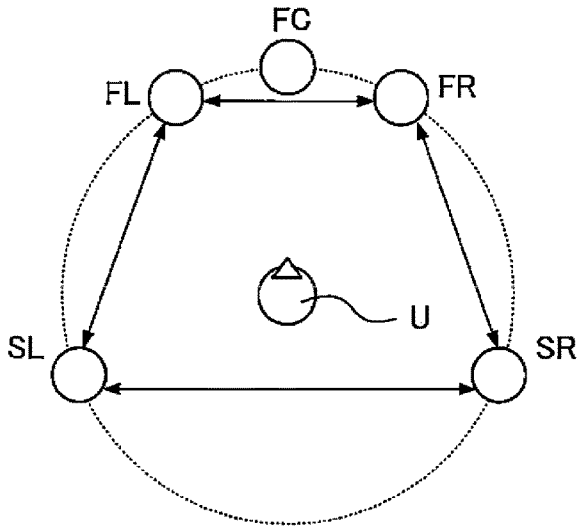
FIG. 5A is a diagram illustrating an example of a pair of adjacent channels in the first embodiment.

For each channel other than the channel for the Low Frequency Effect (LFE) included in 5.1 ch audio, the correlation between adjacent channels is calculated. In 5.1 ch audio signals, the pairs of adjacent channels are the four pairs of FR and FL, FR and SR, FL and SL, and SL and SR, as illustrated in FIG. 5A. At this time, the correlation information of the adjacent channels is calculated by calculating a correlation coefficient $d^f$ of quantized f frequency bands per unit time n, and a sound image localization position θ of each of the f frequency bands based on the correlation coefficient. This is described in PTL 2.

Figure 6:
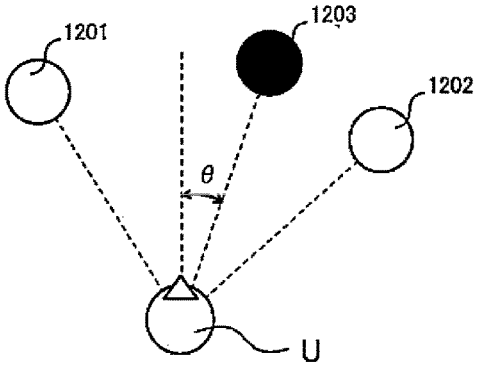
FIG. 6 is a diagram schematically illustrating a calculation result of a virtual audio image position.

For example, as illustrated in FIG. 6, the sound image localization position 1203 based on the correlation between FL 1201 and FR 1202 is expressed as θ with reference to the center of the angle formed by FL 1201 and FR 1202. Equation 1 is used to obtain θ. Here, α is a parameter representing a sound pressure balance (see PTL 2).

[Equation 1]

$$\theta = \sin^{-1}\left(\frac{\alpha - 1}{\alpha + 1}\sin\theta_0\right) \tag{1}$$

In the present embodiment, values having a correlation coefficient $d^f$ that is greater than or equal to a preconfigured threshold Th_d among the quantized f frequency bands are included in the histogram of the localization positions. At this time, the value added to the histogram is n/N. Here, as described above, n is the unit time for calculating the correlation, and N is the total length of the content. In addition, as described above, as the θ obtained as the sound image localization position is based on the center of the sound sources between which the sound image localization point is positioned, conversion to the coordinate system illustrated in FIG. 2A is performed as necessary. The processing described above is similarly performed for combinations other than FL and FR.

Figure 5B:
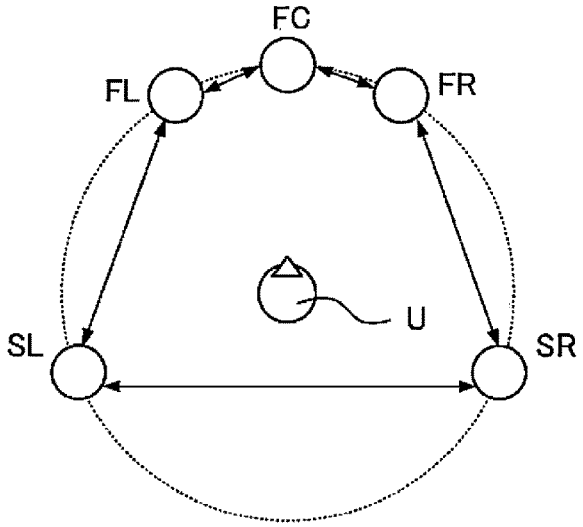
FIG. 5B is a diagram illustrating an example of a pair of adjacent channels in the first embodiment.

It should be noted that, in the above description, as disclosed in PTL 2, with respect to a FC channel to which primarily human dialogue audio and the like are allocated, it is assumed that there are not a large number of locations where sound pressure control is performed to produce a sound image between the FC channel and FL or FR, and FC is excluded from the correlation calculation targets. Instead, the correlation between FL and FR has been considered. However, an aspect of the disclosure is not limited to the above consideration. Naturally, a histogram may be calculated in consideration of the correlation including FC, and as illustrated in FIG. 5B, it is needless to say that a histogram may be generated according to the above calculation method for five pairs of correlations of FC and FR, FC and FL, FR and SR, FL and SL, and SL and SR.

Through the above described processing, even in a case where the playback content includes audio signals other than object-based audio, it is possible to generate a histogram similar to the histogram described for the sound-producing object position information.

Regarding Speaker Arranged Position Calculation Unit 102

Figure 7:
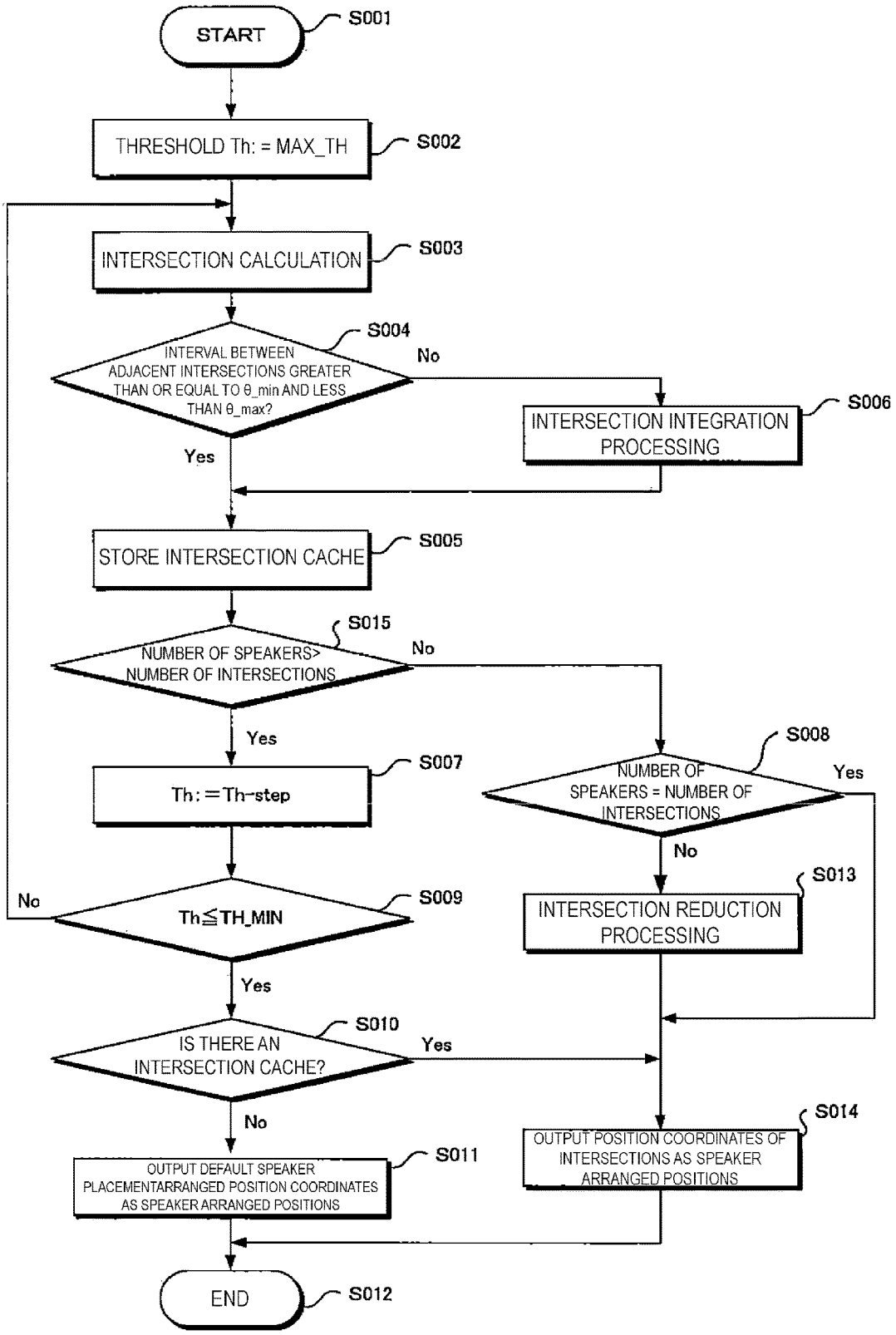
FIG. 7 is a flowchart illustrating an operation of a speaker arranged position calculation unit.

The speaker arranged position calculation unit 102 calculates the arranged positions of the plurality of speakers based on the histogram of the localization positions obtained by the content analysis unit 101. FIG. 7 is a flowchart illustrating an operation of calculating the arranged positions of the plurality of speakers. When a processing of the speaker arranged position calculation unit 102 is initiated (Step S001), a value MAX_TH is configured as a threshold value Th (Step S002). Here, MAX_TH is the maximum value of the histogram of the localization positions that is obtained by the content analysis unit 101. Next, the number of intersections between the threshold value TH and the histogram graph of the localization positions (Step S003) is calculated, and in a case that an interval between an intersection and another adjacent intersection satisfies a preconfigured threshold that is greater than or equal to θ_min and less than θ_max (YES in Step S004), a position of the intersection is stored in a cache area (Step S005), and the processing proceeds to the next step S015.

Figure 8:
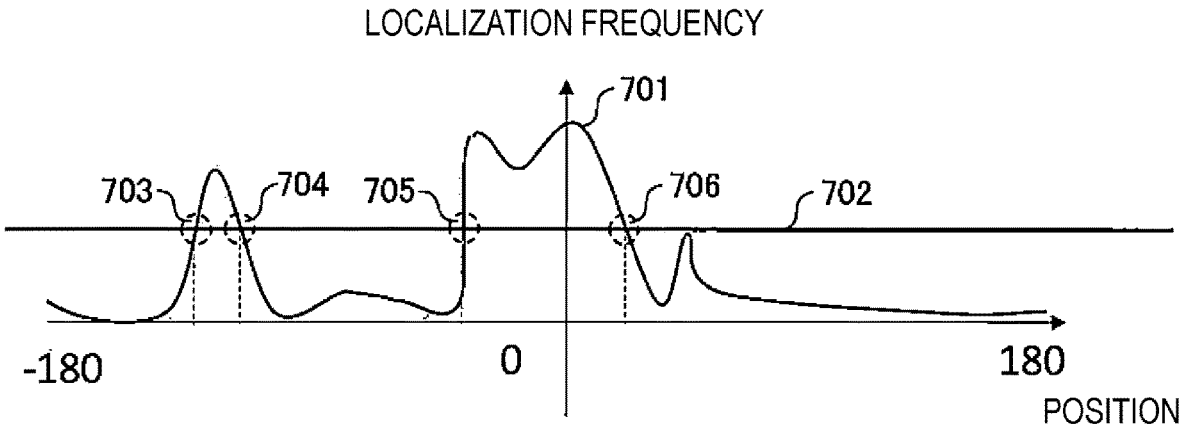
FIG. 8 is a diagram illustrating an intersection between a histogram of localization frequencies and a threshold value in the first embodiment.

FIG. 8 is a schematic diagram illustrating a localization position histogram 701, a threshold value Th 702, and intersections 703, 704, 705, and 706 between the localization position histogram 701 and the threshold value TH 702. Conversely, in a case that an interval between an intersection and another adjacent intersection does not satisfy the threshold greater than or equal to θ_min and less than θ_max, after a pair of intersections with an interval less than the threshold θ_min included among the intersections included is integrated to form a new intersection (Step S006), a position of the new intersection is stored in the cache area (Step S005).

The position of this integrated intersection is set to an intermediate position of the pair of intersections prior to the integration. Next, the number of intersections is compared with the number of speakers, and in a case that "number of speakers>number of intersections" (YES in Step S015), a step value is subtracted from the threshold value Th to obtain a new threshold value Th (Step S007).

Here, in a case that Th is less than or equal to a predetermined threshold lower limit MIN_TH (YES in Step S009), it is checked whether there is cache information that stores the intersection positions. Then, in a case that such cache information is present (YES in Step S010), position coordinates of the intersections stored in the cache are output as speaker arranged positions (Step S014), and the processing ends (Step S012).

Conversely, in a case where cache information that stores the intersections positions is not present (NO in step S010), preconfigured default speaker arranged positions are output as speaker positions (Step S011), and the processing ends (Step S012). In addition, in Step S015, in a case that "number of speakers=number of intersections" (NO in Step S015 and YES in Step S008), the position coordinates of the intersections are output as speaker arranged positions (Step S014), and the processing ends (Step S012).

Further, in a case that "number of speakers<number of intersections" (NO in Step S015 and NO in Step S008), reduction processing is performed for the number of intersections, and after the number of speakers and the number of intersections are caused to coincide (Step S013), the position coordinates of the intersections are output as speaker arranged positions (Step S014), and the processing ends (Step S012).

In the reduction processing for the number of intersections described here, two intersections having the closest distance between intersections are selected and the intersection integration process described in Step S006 is applied to these intersections. Then, the integration process for the intersections with the closest distance is repeated until "the number of speakers=the number of intersections."

The arranged positions of the speakers are determined by the above steps. It should be noted that the various parameters referred to as values preconfigured in the audio signal processing unit 103 are recorded in the storage unit 104 in advance. Of course, a user may be allowed to input these parameters using any user interface (not illustrated).

In addition, it is needless to say that the positions of the speakers may be determined using other methods. For example, speakers may be arranged at positions corresponding to the top 1 to s locations having the largest histogram values; that is, characteristic sound image localization positions. In addition to this, by applying a multi-value quantization method that uses "Otsu's Threshold Selection Method" to the histogram and placing speakers at a calculated number s of threshold positions, speakers may be arranged to cover an entire sound image localization position. Here, s is the number of speakers to be arranged as described above.

Regarding Audio Signal Processing Unit 103

(1) In Cases that Object-Based Audio Signals are Included in Playback Content

Figure 9:
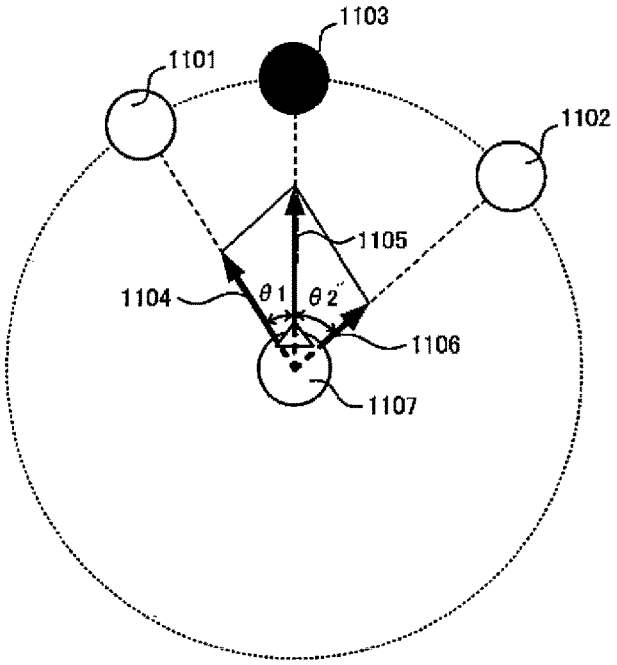
FIG. 9 is a diagram illustrating a concept of vector-based sound pressure panning.

The audio signal processing unit 103 constructs audio signals to be output from speakers based on the arranged positions of the speakers calculated by the speaker arranged position calculation unit 102. FIG. 9 is a diagram illustrating a concept of vector-based sound pressure panning in the second embodiment. In FIG. 9, it is assumed that the position of one sound-producing object in the object-based audio at a particular time is 1103. In addition, in a case that the arranged positions of the speakers calculated by the speaker arranged position calculation unit 102 are designated as 1101 and 1102 to sandwich the sound-producing object position 1103, as illustrated in NPL 2, for example, the sound-producing object is reproduced at the position 1103 by vector-based sound pressure panning using these speakers. In particular, when the intensity of the sound generated from the sound-producing object to the listener 1107 is represented by a vector 1105, this vector is decomposed into a vector 1104 between the listener 1107 and the speaker located at the position 1101 and a vector 1106 between the listener 1107 and the speaker located at the position 1101, and the ratio with respect to the vector 1105 at this time is obtained.

That is, in a case where the ratio between the vector 1104 and the vector 1105 is r1, and the ratio between the vector 1106 and the vector 1105 is r2, then these can be respectively expressed as:

$$r1=\sin(\theta 2)/\sin(\theta 1\pm\theta 2)$$

$$r2=\cos(\theta 2)-\sin(\theta 2)/\tan(\theta 1+\theta 2).$$

By multiplying the audio signal generated from the sound-producing audio by the obtained ratio and playing the multiplied audio signal from the speakers arranged at 1101 and 1102, it is possible for the viewer to perceive the sound-producing object as if it were played from the position 1103. By performing the above processing for all the sound-producing objects, an output audio signal can be generated.

(2) In Cases that Audio Signals Other than Object-Based Audio are Included in Playback Content In this case, for example, in a case where 5.1 ch audio is included, as well, it is considered that one of the recommended arranged positions of the 5.1 ch is position 1103 and the arranged positions of the speakers calculated by the speaker arranged position calculation unit 102 are 1101 and 1102, and the above procedure is performed using the same processing.

Regarding Storage Unit 104

The storage unit 104 includes a secondary storage device configured to store various kinds of data used by the content analysis unit 101. The storage unit 104 includes, for example, a magnetic disk, an optical disk, a flash memory, or the like, and more specific examples include a Hard Disk Drive (HDD), a Solid State Drive (SSD), an SD memory card, a BD, a DVD, or the like. The content analysis unit 101 reads data from the storage unit 104 as necessary. In addition, various parameter data including analysis results can be recorded in the storage unit 104.

Regarding Presenting Unit 105

The presenting unit 105 presents the speaker arranged position information obtained by the speaker arranged position calculation unit 102 to the user. As a presentation method, as illustrated in FIG. 10A, for example, the arranged position relationship between the user and the speakers may be illustrated on a liquid crystal display or the like, or as illustrated in FIG. 10B, the arranged positions may be indicated only by numerical values. In addition, the speaker positions may be presented using methods other than displays. For example, a laser pointer or a projector may be installed near the ceiling, and in coordination with this, the arranged positions may be presented by mapping them to the real world.

Regarding Audio Output Unit 106

The audio output unit 106 outputs the audio obtained by the audio signal processing unit 103. Here, the audio output unit 106 includes a number s of speakers to be arranged and an amplifier for driving the speakers.

It should be noted that, in the present embodiment, although the speaker arrangement has been described on a two-dimensional plane to simplify the explanation and make it easier to understand, an arrangement in a three-dimensional space, as well, is not a problem. That is, the position information of the sound-producing object of the object-based audio may be represented by three-dimensional coordinates including information for the height direction, and a speaker arrangement including vertical positions, such as 22.2 ch audio, may be recommended.

First Modification of First Embodiment

In the first embodiment, although the construction processing for the output audio corresponding to the positions of the speakers is performed by the audio signal processing unit 103 in the speaker arranged position instructing system 1, this function may be carried out externally to the speaker arranged position instructing system. That, is, as illustrated in FIG. 11, the speaker arranged position instructing system 8 according to the first modification of the first embodiment includes a content analysis unit 101 configured to analyze audio signals included in video content and audio content, a storage unit 104 configured to record analysis results obtained by the content analysis unit 101 and various parameters necessary for content analysis, and a speaker arranged position calculation unit 801 configured to calculate the arranged positions of the speakers based on the analysis results obtained by the content analysis unit 101. It should be noted that the speaker arranged position presenting apparatus includes the speaker arranged position instructing system (speaker arranged position instructing unit) 8 and the presenting unit 105.

Further, the speaker arranged position instructing system 8 is connected to external devices including an audio signal processing unit 802 configured to re-synthesize the audio signals to be played by the speakers based on the positions of the speakers calculated by the speaker arranged position calculation unit 801, a presenting unit 105 configured to present the speaker positions to a user, and an audio output unit 106 configured to output an audio signal that has undergone signal processing.

Position information of the speakers as illustrated in the first embodiment is transmitted from the speaker arranged position calculation unit 801 to the audio signal processing unit 802 in a predetermined format such as XML, and in the audio signal processing unit 802, as described in the first embodiment, output audio reconstruction processing is performed by a VBAP method, for example.

It should be noted that, in FIG. 11, elements denoted by the same reference numerals as the other drawings are assumed to have the same functions, and the explanation thereof is omitted herein.

Second Modification of the First Embodiment

Figure 12:
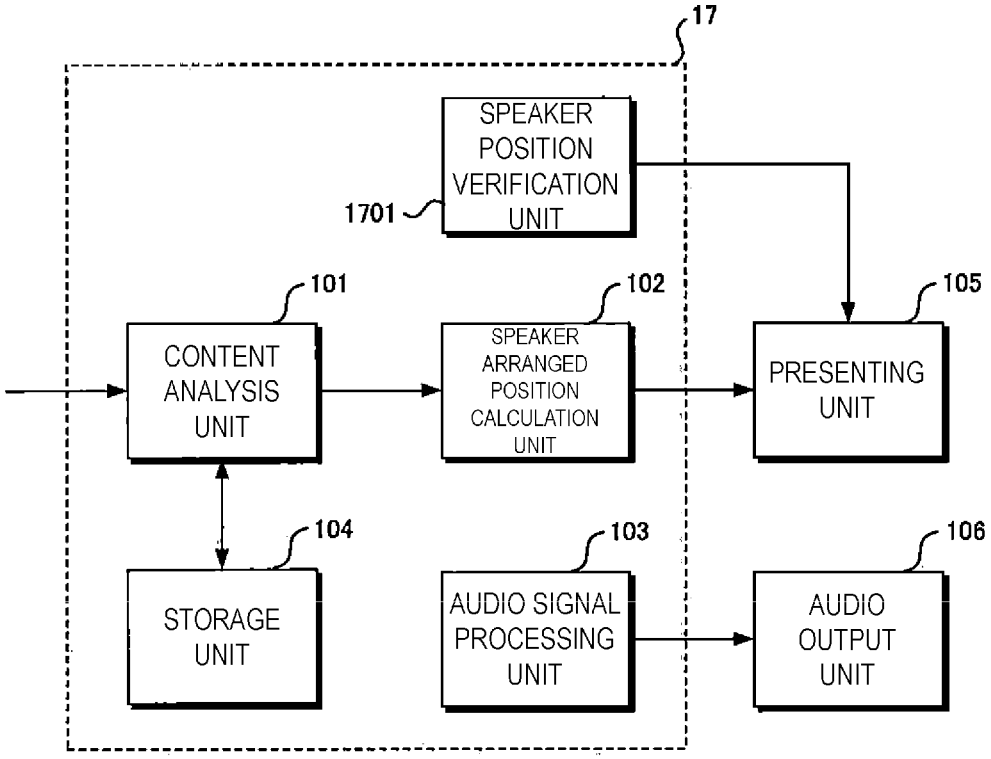
FIG. 12 is a diagram illustrating a schematic configuration of the speaker arranged position instructing system according to a second modification of the first embodiment.

As illustrated in FIG. 12, a speaker position verification unit 1701 may be further provided in the configuration of the first embodiment in order to verify whether the user has arranged speakers at the positions presented by the presenting unit 105. The speaker position verification unit 1701 is provided with at least one microphone, and using this microphone, the actual positions of the speakers are identified by collecting and analyzing the sounds generated from the speakers arranged by the user, using the technique disclosed in PTL 1, for example. In a case that these positions differ from the positions indicated by the presenting unit 105, this fact may be indicated on the presenting unit 105 to notify the user of the fact. It should be noted that the speaker arranged position presenting apparatus includes a speaker arranged position instructing system (speaker arranged position instructing unit) 17 and a presenting unit 105.

Second Embodiment

Figure 13:
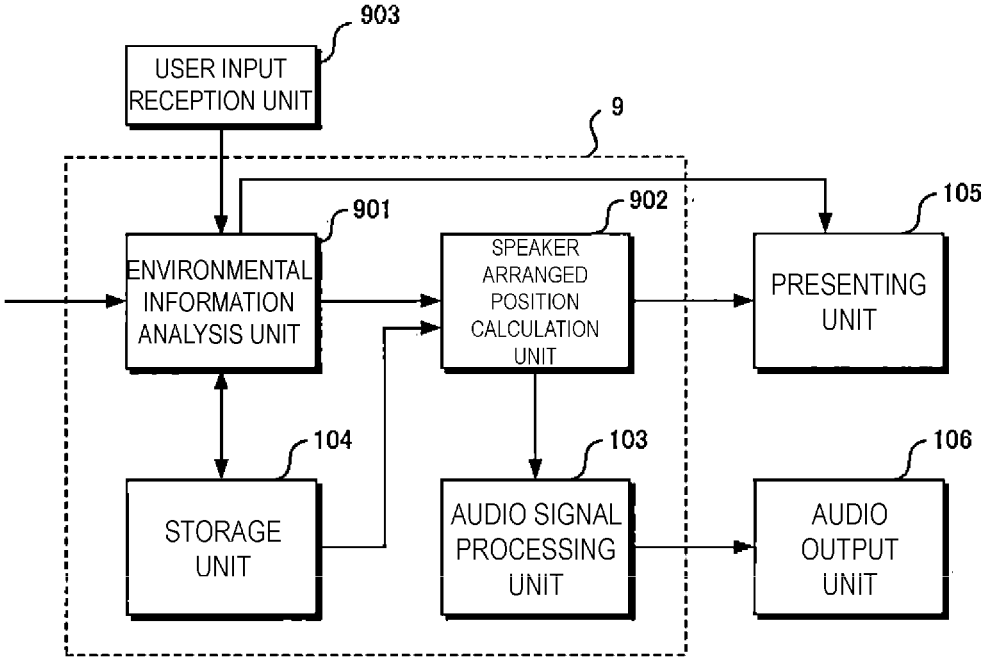
FIG. 13 is a diagram illustrating a schematic configuration of the speaker arranged position instructing system according to a second embodiment.

Next, a second embodiment of the disclosure will be described. FIG. 13 is a diagram illustrating a primary configuration of the speaker arranged position instructing system 9 according to a second embodiment of the disclosure. The speaker arrangement position instructing system 9 according to the second embodiment is a system configured to acquire playback environment information, such as room layout information, for example, and instruct favorable speaker arranged positions based on the playback environment information. As illustrated in FIG. 13, the speaker arranged position instructing system 9 includes an environmental information analysis unit 901 configured to analyze information necessary for speaker arrangement from environmental information obtained from various external devices, a storage unit 104 configured to record analysis results obtained by the environmental information analysis unit 901 and various parameters necessary for environmental information analysis, a speaker arranged position calculation unit 102 configured to calculate the arranged positions of the speakers based on the analysis results obtained by the environmental information analysis unit 901, and an audio signal processing unit 103 configured to re-synthesize the audio signals to be played by speakers based on the positions of the speakers calculated by the speaker arranged position calculation unit 102.

In addition, the speaker arranged position instructing system 9 is connected to external devices including a presenting unit 105 configured to present the speaker positions to a user, and an audio output unit 106 configured to output an audio signal that has undergone signal processing. It should be noted that the speaker arranged position presenting apparatus includes the speaker arranged position instructing system (speaker arranged position instructing unit) 9 and the presenting unit 105.

It should be noted that, in the block diagram illustrated in FIG. 13, as blocks having the same reference numerals as those in FIG. 1 have the same functions, the description thereof will be omitted, and in the present embodiment, the environmental information analysis unit 901 and the speaker arranged position calculation unit 902 will primarily be described.

Regarding Environmental Information Analysis Unit 901

Figure 14A:
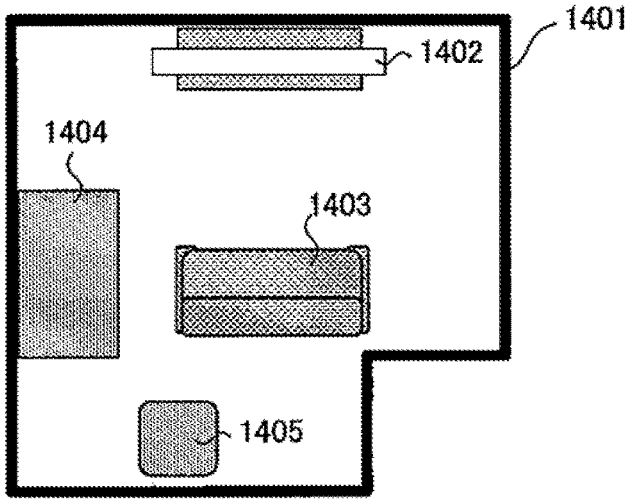
FIG. 14A is a diagram illustrating an installation environment of a speaker in the second embodiment.
Figure 14B:
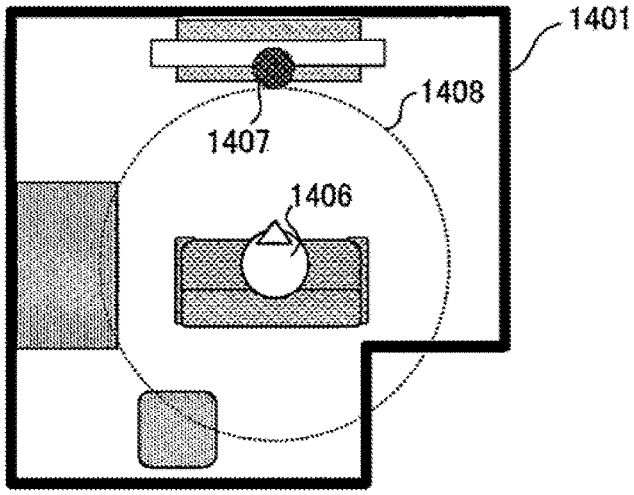
FIG. 14B is a diagram illustrating an installation environment of a speaker in the second embodiment.
Figure 14C:
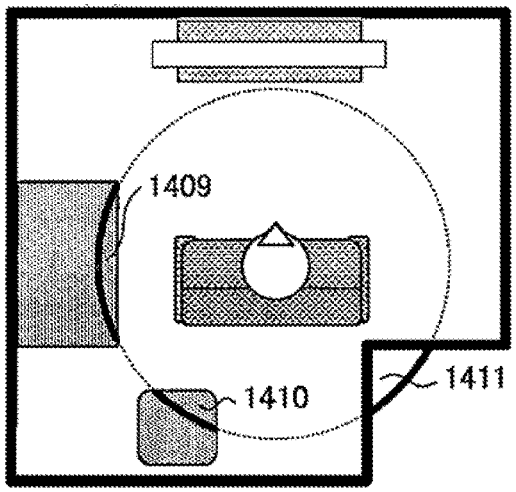
FIG. 14C is a diagram illustrating an installation environment of a speaker in the second embodiment.

The environmental information analysis unit 901 calculates likelihood information for the speaker arranged positions from the input information for the room in which the speakers are to be arranged. First, the environmental information analysis unit 901 acquires a plan view as illustrated in FIG. 14A. An image captured by a camera installed on the ceiling of the room may be used for the plan view, for example. A television 1402, a sofa 1403, and furniture 1404 and 1405 are arranged in the plan view 1401 input in the present embodiment. Here, the environmental information analysis unit 901 presents the plan view 1401 to the user via a presenting unit 103 including a liquid crystal display or the like, and allows the user to input the position 1407 of the television and the viewing position 1406 via the user input reception unit 903.

Figure 15:
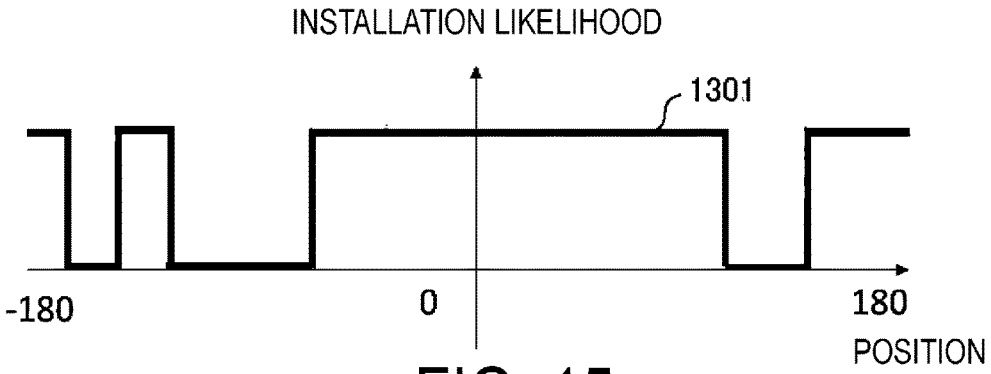
FIG. 15 is a diagram illustrating an example of a speaker installation likelihood in the second embodiment.

As candidates for the positions to place the speakers, the environmental information analysis unit 901 displays, on the plan view 1401, a concentric circle 1408 whose radius is the distance between the input television position 1407 and the viewing position 1406. Further, the environmental information analysis unit 901 allows the user to input areas in which the speaker cannot be arranged in the displayed concentric circle. In the present embodiment, non-installable areas 1409 and 1410 resulting from the arranged furniture, and a non-installable area 1411 resulting from the shape of the room are input. Based on the above inputs, the environmental information analysis unit 901 sets the installation likelihood for speaker installable areas to 1 and sets the installation likelihood for speaker non-installable areas to 0, creates an installation likelihood (graph) 1301 as illustrated in FIG. 15, and delivers this information to the speaker arranged position calculation unit 902.

It should be noted that, in the present embodiment, it is assumed that the input by the user is input via an external device or user input reception unit 903 connected to the environmental information analysis unit 901, and that the user input reception unit 903 includes a touch panel, a mouse, a keyboard, or the like.

Regarding Speaker Arranged Position Calculation Unit 902

Figure 16:
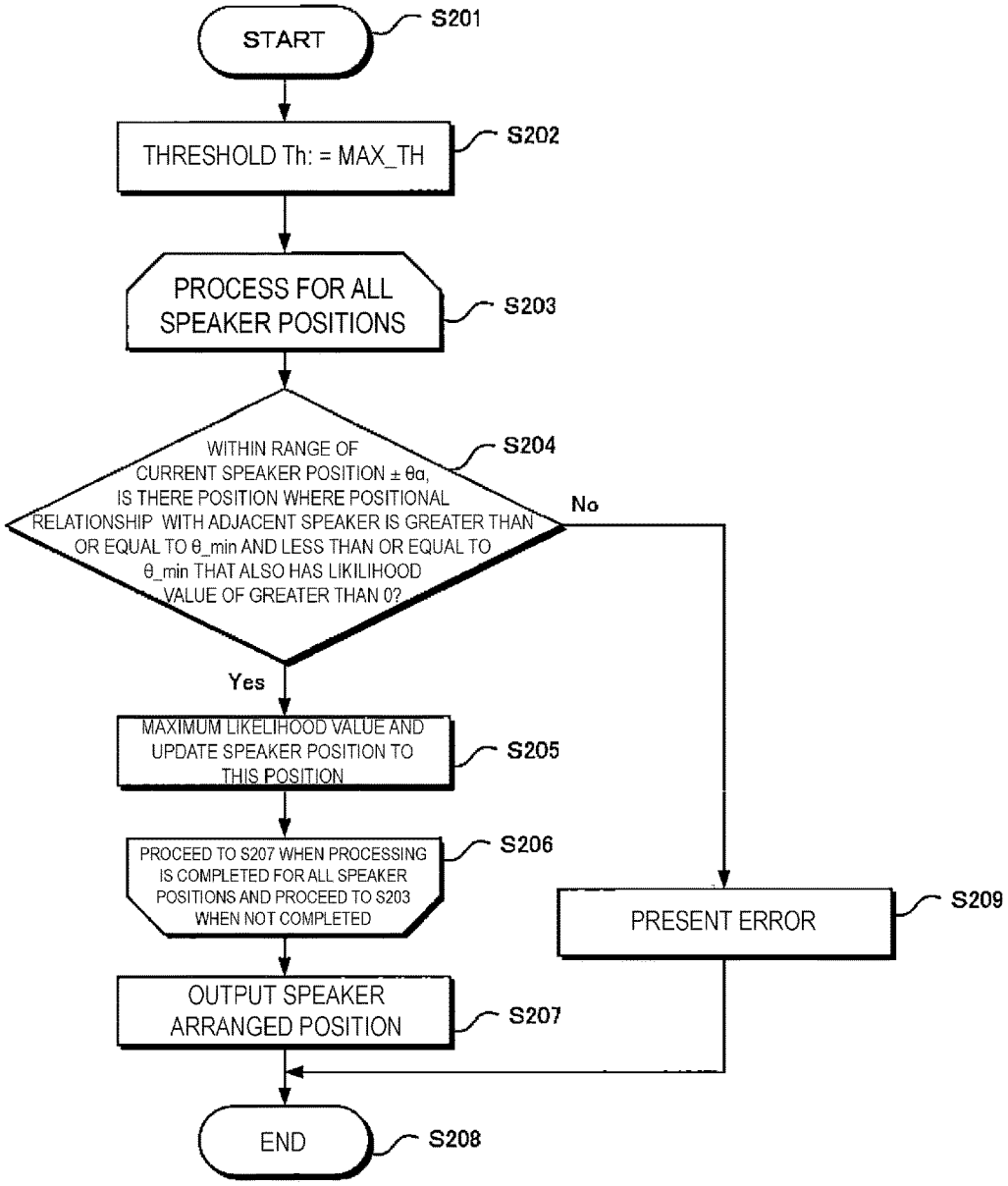
FIG. 16 is a flowchart illustrating an operation of a speaker arranged position calculation unit 902 in the second embodiment.

The speaker arranged position calculation unit 902 determines the positions to place the speakers based on the speaker installation likelihood information obtained from the environmental information analysis unit 901. FIG. 16 is a flowchart illustrating an operation of calculating the speaker arranged positions. When the processing is initiated in FIG. 16 (Step S201), the speaker arranged position calculation unit 902 reads the default speaker arranged position information from the storage unit 104 (Step S202). In the present embodiment, the arranged position information for the speakers other than the speaker for Low Frequency Effect (LFE) of 5.1 ch is read.

Figure 17A:
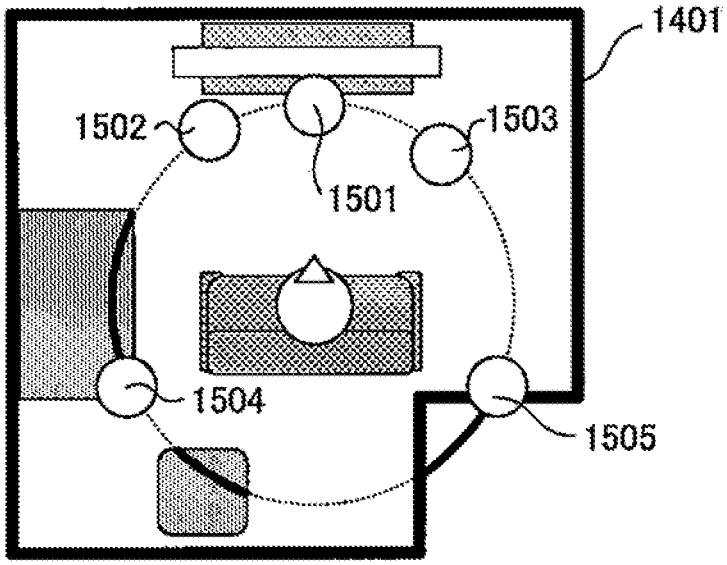
FIG. 17A is a diagram schematically illustrating speaker arranged positions in the second embodiment.

It should be noted that, as illustrated in FIG. 17A, the speaker positions 1501 to 1505 may be displayed using the speaker arranged position information based on the content information described in the first embodiment. That is, the speaker arranged position instructing system 9 described in this embodiment may include the content analysis unit 101.

Next, the speaker arranged position calculation unit 902 repeats the processing from Step S203 to Step S206 for all the read speaker positions. For each speaker position, the speaker arranged position calculation unit 902 checks whether there is a position within a range of $\pm\Theta\alpha$ of the current speaker position where the positional relationship between adjacent speakers is greater than or equal to θ_min and less than θ_max and the likelihood value is greater than 0. In a case that such a position exists (YES in Step S204), the speaker position is updated to the position having the maximum likelihood value among the sets of position information that satisfy this condition (Step S205).

Figure 17B:
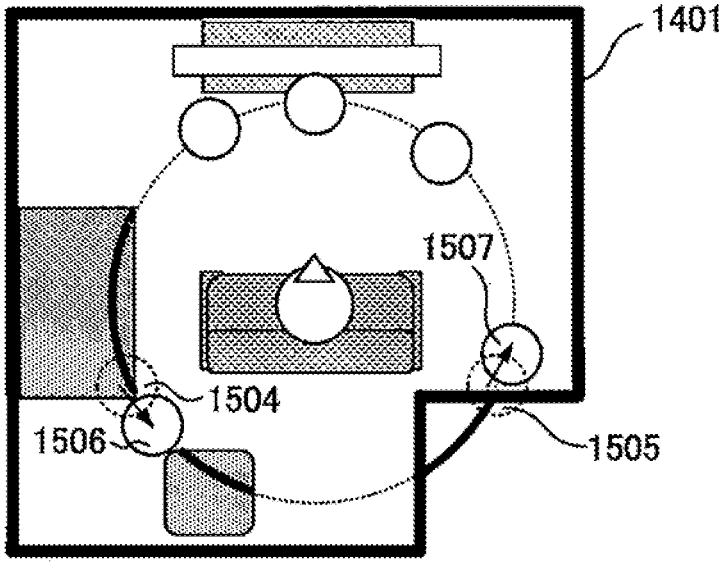
FIG. 17B is a diagram schematically illustrating speaker arranged positions in the second embodiment.

For example, as illustrated in FIG. 17B, the speaker positions whose default positions have been designated as 1504 and 1505 are respectively updated to positions 1506 and 1507 in the plan view 1401 based on the installation likelihood 1301. When processing has been performed for all the speakers, the speaker arranged position is output (Step S207), and the processing ends (Step S208).

Conversely, in a case where even one set of speaker position information that does not satisfy the condition of step S204 is present, it is determined that the arrangement of the speakers is impossible, an error is presented (Step S209), and the processing ends (S208). It should be noted that θα, θ_min, and θ_max are preconfigured values stored in the storage unit 104. Finally, the speaker arranged position calculation unit 902 presents the results obtained by the above processing to the user through the presenting unit 105.

It should be noted that, in the above embodiments, although the installation likelihood is created based on whether installation is physically possible in the room, it is needless to say that the same graph may be created using information other than this. For example, in addition to the positions of walls and furniture, the input from the user in the environmental information analysis unit 901 may allow for input of the material information (wood, metal, concrete) of the walls and furniture to configure the installation likelihoods taking reflection coefficients of the walls and furniture into account.

One embodiment of the disclosure can utilize the following aspects. That is, (1) the speaker arranged position presenting system of one aspect of the disclosure is a speaker arranged position presenting system for presenting arranged positions of a plurality of speakers configured to output audio signals as physical vibrations, the speaker arranged position presenting system including: an analysis unit configured to analyze at least one of a feature amount of input content data or information specifying an environment in which the input content data is to be played; a speaker arranged position calculation unit configured to calculate the arranged positions of the plurality of speakers, based on the feature amount or the information for specifying the environment; and a presenting unit configured to present the arranged positions of the plurality of speakers that have been calculated.

(2) In addition, in the speaker arranged position presenting system of one aspect of the disclosure, the analysis unit is configured to generate, using a position information parameter associated with an audio signal included in the input content data, a histogram for indicating frequency occurrences of audio localizations at candidate positions at which the plurality of speakers are respectively to be arranged; and the speaker arranged position calculation unit is configured to respectively set, as the arranged positions of the plurality of speakers, coordinate positions of intersections when the intersections between a threshold of the frequency occurrences of the audio localizations and the histogram is equal in number to the plurality of speakers.

(3) In addition, in the speaker arranged position presenting system of one aspect of the disclosure, the analysis unit is configured to: calculate, using a position information parameter associated with an audio signal included in the input content data, a correlation value between the audio signals output from adjacent positions, and generate, based on the correlation value, a histogram for indicating frequency occurrences of audio localizations at candidate positions at which the plurality of speakers are respectively to be arranged; and the speaker arranged position calculation unit is configured to respectively set, as the arranged positions of the plurality of speakers, coordinate positions of intersections when the intersections between a threshold of the frequency occurrences of the audio localizations and the histogram is equal in number to the plurality of speakers.

(4) In addition, in the speaker arranged position presenting system of one aspect of the disclosure, the analysis unit is configured to: receive an input of possibility/impossibility information for indicating an area where arrangements of the plurality of speakers are possible or an area where arrangements of the plurality of speakers are impossible, and generate likelihood information for indicating likelihoods of candidate positions at which the plurality of speakers are respectively to be arranged; and the speaker arranged position calculation unit is configured to determine the arranged positions of the plurality of speakers, based on the likelihood information.

(5) In addition, the speaker arranged position presenting system of one aspect of the disclosure further includes a user input reception unit configured to receive a user operation and the input of the possibility/impossibility information for indicating the area where the arrangement of the plurality of speakers are possible or the area where the arrangements of the plurality of speakers are impossible.

(6) In addition, the speaker arranged position presenting system of one aspect of the disclosure further includes an audio signal processing unit configured to generate, based on the information for indicating the arranged positions of the plurality of speakers and the input content data, an audio signal to be output by each of the plurality of speakers.

(7) In addition, a program of one aspect of the disclosure is a program for the speaker arranged position presenting system for presenting arranged positions of the plurality of speakers configured to output multi-channel audio signals as physical vibrations, and causes a computer to perform a series of processes including: a process of analyzing at least one of the feature amount of the input content data or the information for specifying the environment in which the input content data is to be played; a process of calculating the arranged positions of the plurality of speakers based on the feature amount or the information for specifying the environment, which has been analyzed; and a process of presenting the arranged positions of the plurality of speakers that have been calculated.

(8) In addition, a program of one aspect of the disclosure further includes: a process of generating, using a position information parameter associated with an audio signal included in the input content data, a histogram for indicating frequency occurrences of audio localizations at candidate positions at which the plurality of speakers are respectively to be arranged; and a process of setting respectively, as the arranged positions of the plurality of speakers, coordinate positions of intersections when the intersections between a threshold of the frequency occurrences of the audio localizations and the histogram is equal in number to the plurality of speakers.

(9) In addition, a program of one aspect of the disclosure further includes: a process of calculating, using a position information parameter associated with an audio signal included in the input content data, a correlation value between the audio signals output from adjacent positions, and generating, based on the correlation value, a histogram for indicating frequency occurrences of audio localizations at candidate positions at which the plurality of speakers are respectively to be arranged; and a process of setting respectively, as the arranged positions of the plurality of speakers, coordinate positions of intersections when the intersections between a threshold of the frequency occurrences of the audio localizations and the histogram is equal in number to the plurality of speakers.

(10) In addition, a program of one aspect of the disclosure further includes: a process of inputting possibility/impossibility information for indicating an area where arrangements of the plurality of speakers are possible or an area where arrangements of the plurality of speakers are impossible, and generating likelihood information for indicating likelihoods of candidate positions at which the plurality of speakers are respectively to be arranged; and a process of determining the arranged positions of the plurality of speakers, based on the likelihood information.

(11) In addition, a program of one aspect of the disclosure further includes: a process of receiving a user operation in a user input reception unit, and inputting possibility/impossibility information for indicating the area where the arrangements of the plurality of speakers are possible or the area where the arrangements of the plurality of speakers are impossible.

(12) In addition, a program of one aspect of the disclosure further includes: a process of generating, based on the information for indicating the arranged positions of the plurality of speakers and the input content data, an audio signal to be output by each of the plurality of speakers.

As described above, according to the present embodiment, it is possible to automatically calculate arranged positions of a plurality of speakers that are suitable to a user, and to provide the arranged positions information to the user.

CROSS-REFERENCE OF RELATED APPLICATION

This application claims the benefit of priority to JP 2015-248970 filed on Dec. 21, 2015, which is incorporated herein by reference in its entirety.

REFERENCE SIGNS LIST

1 Speaker arranged position instructing system (speaker arranged position instructing unit)
4 Histogram
8 Speaker arranged position instructing system (speaker arranged position instructing unit)
9 Speaker arranged position instructing system (speaker arranged position instructing unit)
101 Content analysis unit
102 Speaker arranged position calculation unit
103 Audio signal processing unit
104 Storage unit
105 Presenting unit
106 Audio output unit
201 Center channel

202 Front right channel
203 Front left channel
204 Surround right channel
205 Surround left channel
701 Localization position histogram
702 Threshold Th
703, 704, 705, 706 Intersection
801 Speaker arranged position calculation unit
802 Audio signal processing unit
901 Environmental information analysis unit
902 Speaker arranged position calculation unit
903 User input reception unit
1101, 1102 Position of sound-producing object
1103 Position of one sound-producing object at a particular time in object-based audio
1104, 1105, 1106 Vector
1107 Listener
1201 FL (front left channel)
1202 FR (front right channel)
1203 Audio image localization position
1301 Installation likelihood
1401 Plan view
1402 Television
1403 Sofa
1404, 1405 Furniture
1406 Viewing position
1407 Input television position
1408 Concentric circle
1409, 1410, 1411 Non-installable area
1501, 1502, 1503, 1504, 1505, 1506, 1507 Speaker position

The invention claimed is:

1. A speaker arranged position presenting apparatus for presenting arranged positions of a plurality of speakers, the speaker arranged position presenting apparatus comprising:

speaker arranged position instructing circuitry configured to analyze a feature amount included in input content data including at least an audio signal to calculate candidate positions at which the plurality of speakers are respectively to be arranged; and presenting circuitry configured to present the calculated candidate positions.

2. A speaker arranged position presenting apparatus for presenting arranged positions of a plurality of speakers, the speaker arranged position presenting apparatus comprising:

speaker arranged position instructing circuitry configured to (i) receive an input of possibility/impossibility information for indicating a physical area where arrangements of the plurality of speakers are possible or a physical area where arrangements of the plurality of speakers are impossible, (ii) generate likelihood information for indicating likelihoods of candidate positions at which the plurality of speakers are respectively to be arranged, based on the received possibility/impossibility information, and (iii) determine the candidate positions at which the plurality of speakers are respectively to be arranged, based on the likelihood information; and presenting circuitry configured to present the candidate positions that have been calculated.

3. The speaker arranged position presenting apparatus according to claim 2, further comprising:

user input reception circuitry configured to receive a user operation and the input of the possibility/impossibility information for indicating the physical area where the arrangements of the plurality of the speaker are possible or the physical area where the arrangements of the plurality of the speaker are impossible.

4. The speaker arranged position presenting apparatus according to claim 1, wherein the content data further includes a position information parameter, the feature amount is the position information parameter, and the speaker arranged position instructing circuitry analyzes the position information parameter to calculate the candidate positions at which the plurality of speakers are respectively to be arranged.

5. The speaker arranged position presenting apparatus according to claim 1, wherein the feature amount is a correlation value calculated by the speaker arranged position instructing circuitry using audio signals output from adjacent speakers, and the speaker arranged position instructing circuitry analyzes the correlation value to calculate the candidate positions at which the plurality of speakers are respectively to be arranged.

6. The speaker arranged position presenting apparatus according to claim 5, wherein the speaker arranged position instructing circuitry calculates the candidate positions at which the plurality of speakers are respectively to be arranged, based also on frequency occurrences of audio localizations at the candidate positions at which the plurality of speakers are respectively to be arranged.

* * * * *